United States Patent [19]

Roehlk

[11] Patent Number: 4,805,899

[45] Date of Patent: Feb. 21, 1989

[54] ARM AND WRIST EXERCISE APPARATUS

[76] Inventor: Ruth P. Roehlk, 25804 Texas Ct., Sun Lakes, Ariz. 85248

[21] Appl. No.: 160,039

[22] Filed: Feb. 24, 1988

[51] Int. Cl.[4] ..... A63B 21/32

[52] U.S. Cl. ..... 272/67; 272/140

[58] Field of Search ..... 272/67, 68, 93, 125, 272/132, 135–143

[56] References Cited

U.S. PATENT DOCUMENTS

| | | | |
|---|---|---|---|
| 684,117 | 10/1901 | Sloan | 272/68 |
| 3,445,109 | 5/1969 | Kolbel | 272/137 |
| 3,746,336 | 7/1973 | Tanimoto | 272/142 X |
| 4,039,185 | 8/1977 | Rhoades | 272/68 X |
| 4,610,448 | 9/1986 | Hill | 272/93 |
| 4,651,985 | 3/1987 | Salisbury | 272/68 |

FOREIGN PATENT DOCUMENTS

| | | | |
|---|---|---|---|
| 1261677 | 10/1986 | U.S.S.R. | 272/68 |
| 1268178 | 11/1986 | U.S.S.R. | 272/67 |
| 2056866 | 3/1981 | United Kingdom | 272/141 |

OTHER PUBLICATIONS

Advertisement for the "Double Twist Wrist" in Marcy Sporting Equipment Catalog; 1970; p. 8

Advertisement for the "SportsMate" in Nautilus Sporting Equipment Catalog; Jun., 1979; pp. 28–29.

*Primary Examiner*—Richard J. Apley

*Assistant Examiner*—Robert D. Bahr

*Attorney, Agent, or Firm*—Henderson & Sturm

[57] ABSTRACT

An arm and wrist exercise apparatus (10) comprising a pair of handle units (11) and a pair of intertwined spring units (12); wherein, each of the spring units (12) is operatively engaged to the pair of handle units (11).

6 Claims, 1 Drawing Sheet

ARM AND WRIST EXERCISE APPARATUS

TECHNICAL FIELD

This invention relates to the field of exercise equipment in general and more particularly to an apparatus used to strengthen a person's arms and wrists.

BACKGROUND OF THE INVENTION

As can be seen by reference to the following U.S. Pat. No's: 4,591,151; 4,632,383; 4,643,417; and, 4,171,802 the prior art is replete with myriad and diverse arm and wrist exercising devices.

While all of the aforementioned prior art constructions are more than adequate for the particular purpose for which they have been specifically designed and constructed, these patented structures by no means define the last advancements in this particular area of technology.

While the use of both spring and hydraulic resistance are well recognized expedients in the wrist and arm exercising devices that are represented by the above cited patents; the prior art appears to be silent with regard to a dual spring resistance arrangement; wherein, both of the spring elements are intertwined with one another and the opposed coils of the respective spring elements are adapted to engage one another, as the compressive resistance of the spring increases due to the manipulations of the user.

Obviously, there has existed a longstanding need among users of this type of a device for a new arm and wrist exercising apparatus, and the provision of such an apparatus is the stated purpose and intent of the present invention.

BRIEF SUMMARY OF THE INVENTION

The arm and wrist exercising apparatus that forms the basis of the present invention comprises in general: a pair of handle units, and a plurality of spring units that are operatively engaged on their opposite ends to the handle units.

Each of the handle units comprise a handle member connected to a generally flat disc member; wherein, at least one of the disc members is provided with a cylindrical extension member. In addition, the at least one cylindrical disk member serves as a bearing surface for the plurality of spring units; whereby, the inward contraction of the spring elements due to an external torsional force applied by the user will be limited by the presence of the at least one cylindrical disc member.

The plurality of spring units comprises a complimentary pair of configured helical spring members; wherein, each of the spring members have free ends which project tangentially from the wound helical coils of the individual spring members in such a manner that the free ends of the spring member are aligned parallel to one another faced in opposite directions and on opposite sides of the coiled helical configuration of the individual spring members.

In addition, each of the disc members of the handle units are provided with a pair of opposed recesses that are dimensioned to engage one of the free ends of each of the helical spring members; wherein, the complimentary configured spring members are dimensioned and configured to be disposed in an intertwining relationship with one another.

The foregoing arrangement allows the user to grasp the opposed handle members to exert a torsional force with respect to the handle units; wherein, the torsional force exerted by the user is opposed by the torsional resistance provided by the plurality of spring units. As the users torsional force increases in one direction of rotation, the spacing between the intertwined coils of the spring units will decrease, and as the torsional force applied by the user in another direction of rotation increases, the spacing between the intertwined coils will increase.

BRIEF DESCRIPTION OF THE DRAWINGS

These and other objects, advantages, and novel features of the invention will become apparent from the detailed description of the best mode for carrying out the preferred embodiment of the invention which follows; particularly when considered in conjunction with the accompanying drawings, wherein.

BEST MODE FOR CARRYING OUT THE INVENTION

Figure 1:
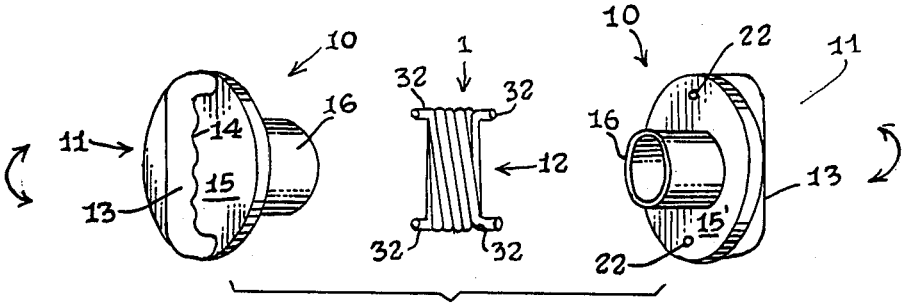
FIG. 1 is an exploded perspective view of one version of the preferred embodiment of this invention.

As can be seen by reference to the drawings and in particular to FIG. 1, the wrist and arm exercise apparatus that forms the basis of the present invention is designated generally by the reference numeral (10). The exercise apparatus (10) comprises in general: a pair of handle units (11); and a pair of spring units (12) that are operatively attached to handle units (11). These units will now be described in seriatim fashion.

Figure 2:
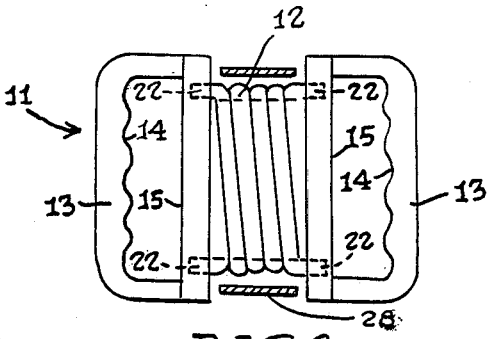
FIG. 2 is a side plan view of the embodiment of FIG. 1.

As can best be seen by reference to FIGS. 1 and 2, each of the handle units (11) comprise a generally U-shaped handle member (13) having a plurality of finger and thumb recesses (14) formed on the bottom of the U-shaped handle configuration; wherein, each of the handle members (13) is operatively connected to a generally flat disc member (15); and wherein, the handle members (13) are disposed generally perpendicular to the plane of the disc members (15).

In the first version of the preferred embodiment illustrated in FIGS. 1 and 2, the bottom surface (15') of each of the disc members (15) is provided with a centrally disposed stem member (16); wherein, the stem members (16) comprise hollow tubular stem elements (17) that are adapted to be telescopically engageable relative to one another.

Figure 3:
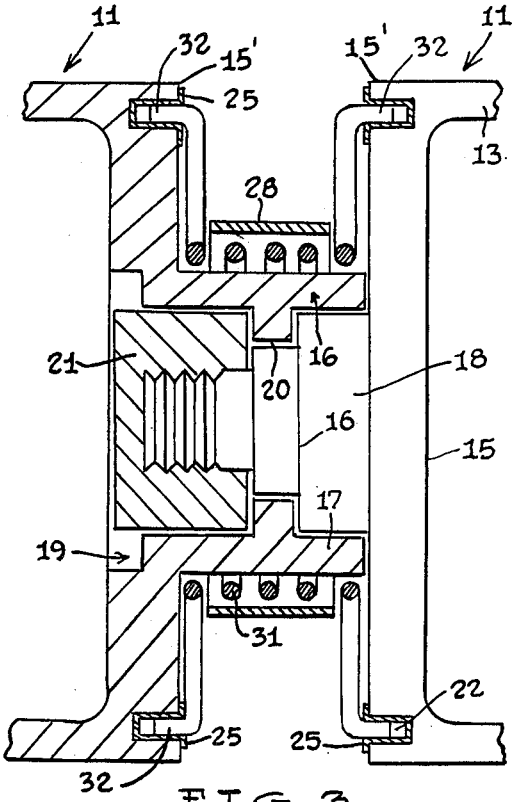
FIG. 3 is an enlarged cross-sectional view of another version of the preferred embodiment of this invention; and, FIG. 4 is an isolated side plan view of the spring units employed in this invention.

In the second version of the preferred embodiment depicted in FIG. 3, the bottom surfaces (15') of each of the disc members (15) are provided with a centrally disposed stem member (16). However, in this version one of the stem members (16) comprises an elongated stepped shoulder threaded stem element (18); and, the other stem member (16) comprises a hollow tubular stem element (17) having a central aperture (19) which extends through the disc member (15) of its associated handle unit (11). In addition, the central aperture (19) is provided with a reduced diameter neck portion (20) that is dimensioned to receive the threaded stem element (18) of the other disc unit (13); whereby an enlarged threaded member (21) may engage the threaded stem element (18) of the other side of the reduced diameter neck portion (20), to operatively and rotatably engage the handle units (13) relative to one another.

It should also be noted at this juncture that in both versions of the preferred embodiment, the bottom surfaces (15') of each of the disc members (15) are provided with a widely spaced opposed pair of recesses (22); wherein the purpose and function of these recesses will be explained presently.

Figure 4:
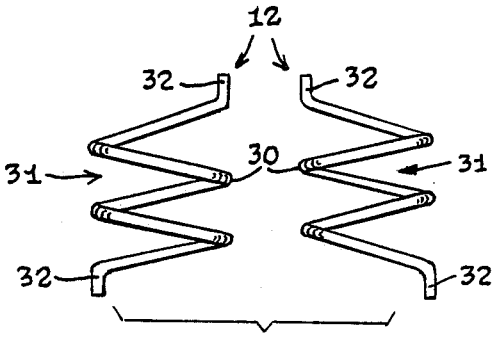

As shown in the drawings and in particular in FIG. 4, each of the pair of spring units (12) comprise a helical spring member (30) including a helically wound spring element (31) whose free ends (32) are tangentially disposed relative to the adjacent wound helical coils of the spring element (31). In addition, the free ends (32) of each spring element (31) are oriented in such a manner that the free ends (32) are aligned parallel to one another faced in opposite directions and disposed on opposite sides of the respective spring elements in the manner depicted in FIG. 4.

Furthermore, the respective spring elements (31) have complimentary configurations; whereby, the spring elements (31) may be intertwined with the coils of one spring element (31) assuming an overlapping relationship with respect to the coils of the other spring elements (31).

Turning once more to FIG. 3, it can be appreciated that both versions of the preferred embodiment of this invention contemplate the insertion of the free ends (32) of each of the spring elements (31) into one of the recesses (22) formed on the bottom surface (15') of each of the disc members (15). In addition, this invention also contemplates the use of bearing inserts (25) in each of the recesses (22) on the respective discs (15), to reduce the frictional wear between the free ends (32) of the spring elements (31) and the recesses (22). Furthermore, this invention contemplates the use of a spring element capturing collar member (28) that will limit the expansion of the spring elements (31) when the apparatus (10) is rotated in one direction.

By now it should be appreciated that the arm and wrist exercise apparatus (10) of this invention is employed by grasping the handle members (13) and rotating the handle units in opposite directions against the force of the spring units (12). It should also be appreciated that when the handle units (11) are rotated in one direction relative to one another the individual coils of the respective spring units (12) will be contracted relative to themselves and the adjacent spring unit (12); and, when the handle units (12) are rotated in the other direction relative to one another the individual coils of the respective spring units (12) will be expanded in a like manner.

As a consequence of the foregoing situation, the larger diameter stem member (16) in both versions of the preferred embodiment act as a spring contraction stop member; and, the spring element capturing collar member (28) acts as a spring expansion stop member.

Having thereby described the subject matter of this invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An arm and wrist exercise apparatus comprising:

a pair of handle units wherein each of the handle units comprises a disc member and a generally U-shaped handle member disposed in a generally perpendicular relationship relative to the disc member; and wherein, the bottom surface of each of the disc member is provided with widely spaced and opposed recesses; wherein, the bottom surface of each of said disc members are further provided with stem elements that are adapted to operatively engage one another; and, a pair of spring units operatively attached on their opposite ends to each of the said disc members; wherein, each of the said pair of spring units comprise: a helical spring member including a coiled helical spring element; wherein, the free ends of the spring element are disposed in a tangential relationship to the helical coils of the spring element; and wherein, said free ends of the spring element are adapted to be received in one of the said widely spaced and opposed recesses in each of the handle units; and, wherein the free ends of each of said spring elements are aligned in a parallel relationship, faced in opposite directions, and disposed on opposite sides of the respective spring elements.

2. The exercise apparatus as in claim 1 wherein said stem members comprise a pair of hollow tubular stem elements that are adapted to be telescopically engaged together.

3. The exercise apparatus as in claim 1 wherein one of said stem members comprises a hollow tubular stem element.

4. The exercise apparatus as in claim 3 wherein the hollow tubular stem element includes a central aperture that extends through said disc member; wherein, the aperture includes a reduced diameter neck portion.

5. The exercise apparatus as in claim 4 wherein the other of said stem members comprises a reduced diameter stepped shoulder threaded stem element; wherein, the threaded end of the stem element is dimensioned to pass through the reduced diameter neck portion in the said one of said stem members.

6. The exercise apparatus as in claim 1 further comprising:

a spring capturing collar member that is dimensioned to surround said pair of spring units.

* * * * *